US005224758A

United States Patent [19]

Takamatsu et al.

[11] Patent Number: 5,224,758

[45] Date of Patent: Jul. 6, 1993

[54] TILTING CONTROL ASSEMBLY FOR CHAIR

[75] Inventors: Shunichi Takamatsu, Osaka; Hirozi Kubo, Yahata; Katsunori Hama, Nishinomiya; Hiroshi Iwabuchi, Yahata, all of Japan

[73] Assignee: Itoki Crebio Corporation, Osaka, Japan

[21] Appl. No.: 633,962

[22] Filed: Dec. 26, 1990

[30] Foreign Application Priority Data

Dec. 27, 1989 [JP] Japan ..... 1-152882[U]
Aug. 29, 1990 [JP] Japan ..... 2-91110[U]

[51] Int. Cl.[5] ..... A47C 1/02

[52] U.S. Cl. ..... 297/301; 297/302; 297/304

[58] Field of Search ..... 297/316, 322, 326, 327, 297/301-309

[56] References Cited

U.S. PATENT DOCUMENTS 4,640,548 2/1987 Desanta ..... 297/301 X
4,761,033 8/1988 Lanuzzi et al. ..... 297/301 X
4,779,925 10/1988 Heinzel ..... 297/301
4,962,962 10/1990 Machate et al. ..... 297/302 X
5,018,787 5/1991 Estkowski ..... 297/304 X

FOREIGN PATENT DOCUMENTS 1184108 3/1985 Canada ..... 297/301
1955531 5/1971 Fed. Rep. of Germany ..... 297/302

*Primary Examiner*—Peter A. Aschenbrenner
*Attorney, Agent, or Firm*—Marks & Murase

[57] ABSTRACT

The present invention provides a chair tilting control assembly which comprises a fixed frame mounted on a chair leg post, a tiltable member supported by the fixed frame to tilt downward about a lateral support shaft, and a chair seat movable downward under the weight of a sitter. The tilting control assembly comprises at least one tilting control spring for elastically supporting the tiltable member at a certain support position relative thereto, and a motion converting mechanism which converts downward movement of the seat into displacement of the support position rearwardly away from the lateral support shaft.

9 Claims, 18 Drawing Sheets

B
C'
3
40
40a
42
41
15
7
XIII
21
48
S
C
4649
47
43
43a
44
22
45
6
16
17
1
16a
16b
XII
45a
XI
1a
4
41
2

TILTING CONTROL ASSEMBLY FOR CHAIR

BACKGROUND OF THE INVENTION

1. Field of the Invention

This invention relates generally to chairs for use in offices for example. More particularly, the invention relates to chairs of the type wherein the chair seat and/or the chair back are designed to be tiltable at least rearwardly downward against a spring or springs.

2. Description of the Prior Art

There have been proposed various types of tiltable chairs wherein at least one of the chair seat and the chair back is tiltable against a tilting control spring or springs. The most typical is a rocking chair wherein the seat is rearwardly tiltable together with the chair back. Such a chair enables the user to assume a relaxing posture occasionally during desk work for example.

As is well known, the tilting degree or angle of a tiltable chair seat and/or back is generally proportional to the weight of the use but inversely proportional to the spring constant of a tilting control spring or springs. Thus, for a given weight, the tilting degree increases with decreasing spring constant, and decreases with increasing spring constant.

Most commonly used as a tilting control spring is a coil spring whose spring constant is invariable. Thus, a tiltable chair utilizing a tilting control coil spring or springs has a disadvantage that the tilting degree inevitably varies depending on the weight of a particular user with no possibility of adjusting the tilting degree to suit the user's weight.

U.S. Pat. No. 4,077,596 discloses a chair tilting control assembly which comprise a pair of tilting control plate springs each fixed at one end in a cantilever fashion for elastically allowing rearwardly downward tilting of the chair seat and back. Specifically, the weight of the sitter applied to the seat is elastically supported by the plate springs via a U-shaped rod which provides a load applying member carried by the seat. The U-shaped rod is designed to be advanced or retreated relative to the plate springs by manually turning an adjusting screw. Thus, the spring constant of the plate springs can be adjusted to suit the weight of the user.

However, the tilting control assembly of the above U.S. patent is disadvantageous in that it requires manual adjustment upon every change of the user. Further, the manual adjustment is cumbersome and time-taking, so that the user often prefers uncomfortable chair tilting than making such an adjustment. Moreover, the manual adjustment is a guess game, and therefore does not necessarily result in comfortable chair tilting.

Further, each tilting control plate spring of the above U.S. patent is made to extend away from the pivotal axis of the seat, and the U-shaped rod as a load applying member is advanced closer to the pivotal axis (toward the fixed ends of the springs) for increasing the spring constant of the tilting control spring. Therefore, the reaction moment arm length of the tilting control spring decreases as the spring constant thereof increases. Obviously, with a larger reaction moment arm length, the plate spring provides a stronger support against tilting of the chair. Thus, the adjustment of the spring constant is contradicted by simultaneous reduction of the reaction moment arm length.

Moreover, each tilting control spring of the above U.S. patent is fixed in position, and has a uniform width and thickness. Thus, the tilting control spring has a limited range of spring constant adjustment, and is therefore incapable of providing an optimum tilting support for a wide range of users varying in weight for example from 40 kg to 100 kg.

SUMMARY OF THE INVENTION

It is, therefore, a general object of the present invention to provide a chair tilting control assembly which is capable of automatically adjusting the tilting support ability of the tilting control spring or springs.

A more specific object of the present invention is to provide a chair tilting control assembly which is capable of automatically increasing the reaction moment arm length of the tilting control spring or springs as the weight of a sitter increases.

A further object of the present invention is to provide a chair tilting control assembly which is capable of adjusting the tilting support ability to cope with a wide range of weight variations.

According to the present invention, there is provided a tilting control assembly for a chair, the chair comprising support means; a tiltable member pivotally connected to the support means by lateral support shaft means, the tiltable member being downwardly tiltable by pivoting about the lateral support shaft means; and a seat carrier arranged to move downwardly under the weight of a sitter; the tilting control assembly comprising: tilting control spring means providing a support position for elastically supporting the tiltable member against downward tilting thereof relative to the support means; and displacing means responsive to the weight for automatically displacing the support position in a manner such that the support position becomes farther from the support shaft means as the weight increases.

With the arrangement described above, the displacing means automatically responds to the weight of the user to displace the support position (namely, the spring acting point relative to the tiltable member) away from the lateral support shaft means. The degree of such displacement increases as the sitter's weight increase. Thus, the distance between the spring acting point and the lateral support shaft, i.e., the reaction moment arm length of the tilting control spring means increases as the sitter's weight increases.

Further, when the reaction moment arm length of the tilting control spring means increases, the degree of elastic deformation of the spring means for a given tilting angle of the tiltable member also increases. Thus, the tilting control spring means resists against downward tilting of the tiltable member more strongly for a heavier sitter than for a lighter sitter, thereby requiring the heavier sitter to apply a larger leaning load.

In this way, the tilting control spring means is automatically adjusted in its tilting support ability to best suit the sitter's weight. In other words, the tilting control spring means provides a harder or stronger tilting support for a heavier user but a softer or weaker tilting support for a lighter sitter, so that the tiltable member is tilted generally to the same degree for all sitters.

As described above, the tilting support ability of the tilting control spring means is influenced by two factors. The first factor is that the reaction moment arm length of the tilting control spring is increased in roughly proportional relation to the sitter's weight. The second factor, which is attendant with the first factor, is that the elastic deformation of the tilting control spring also increases in generally proportional relation to the sitter's weight. These two factors are positively combined with each other to increase the adjusting sensitivity to weight variations and to expand the adjustable range for covering users of greatly varying weights.

Other objects, features and advantages of the present invention will be fully understood from the following detailed description of the preferred embodiments given with reference to the accompanying drawings.

DETAILED DESCRIPTION OF PREFERRED EMBODIMENTS

Figure 1:
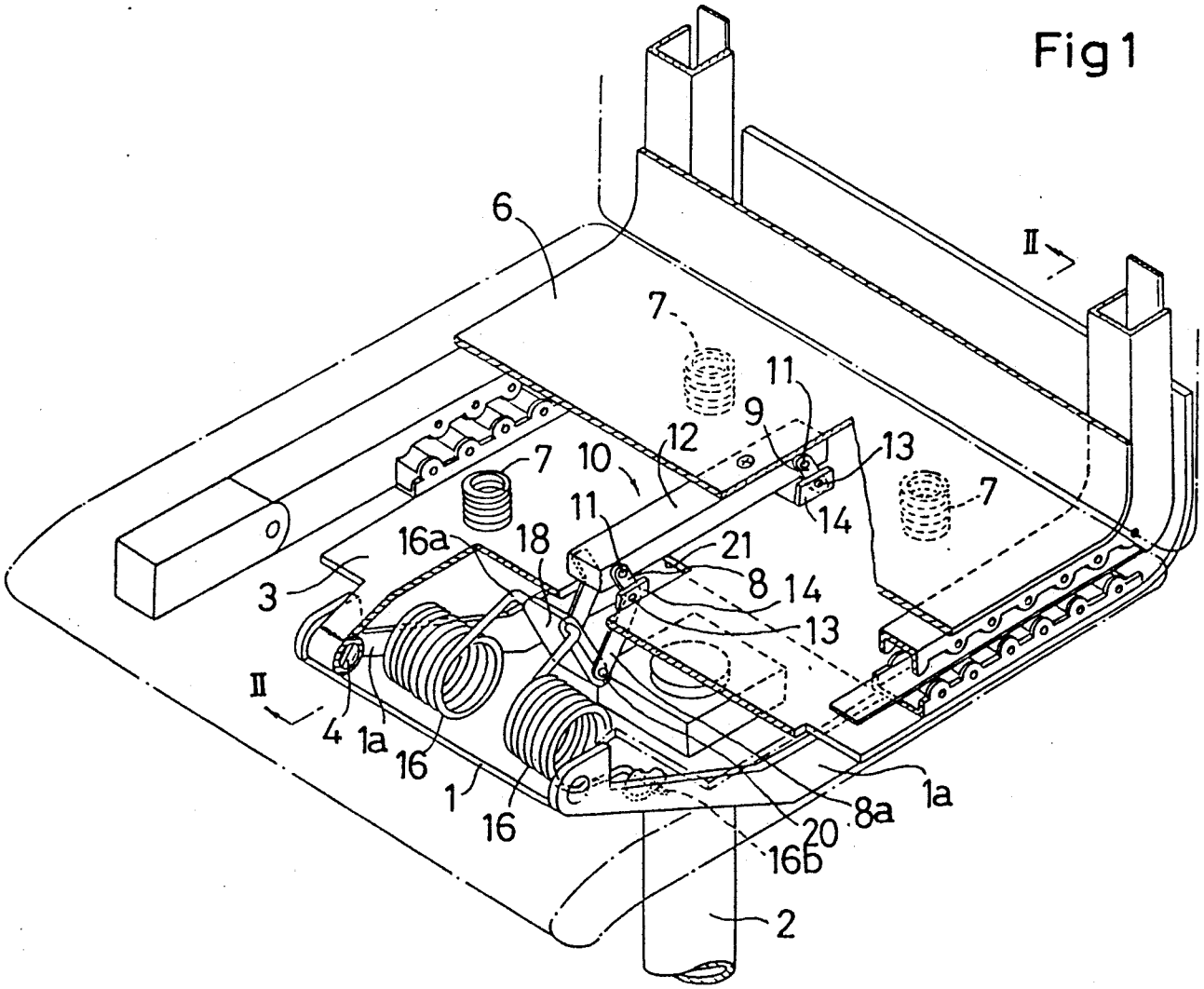
FIG. 1 is a perspective view showing a rocking chair according to a first embodiment of the present invention.

Throughout the accompanying drawings, identical or functionally similar parts are designated by the same reference numerals for clarity of the following description.

Referring first to FIGS. 1 through 6 showing a first embodiment of the present invention, there is illustrated a rocking chair which comprises a fixed frame 1 mounted to the upper end of a chair leg post 2, and a tiltable member 3 mounted to the fixed frame 1. The fixed frame 1 has a pair of upturned side flanges 1*a*, and a lateral support shaft 4 extends between the pair of side flanges 1*a* at the forward end of the fixed frame. The tiltable member 3 has a forward end pivotally supported on the lateral shaft 4. A torsional coil spring (not shown) is fitted around the lateral shaft 4 to upwardly urge the tiltable member 3, thus normally holding the tiltable member at a substantially horizontal position.

The illustrated tiltable member 3 is in the form of a sheet plate bent into a generally L-shape and made of a hard material such as metal or fiber-reinforced plastic which is substantially inflexible. The tiltable member carries a chair seat S and a chair back B. A leaning load on the back B is applied to the tiltable member 3 via presser elements 5 (only one shown in FIG. 2).

The seat S is received on a plate-like seat carrier 6 and includes a cushion member C. The illustrated seat carrier 6 is bent into a generally L-shape for further receiving the back B which also includes a cushion member C'.

The seat carrier 6 together with the seat B thereon is always urged upwardly by means of weight responsive compression coil springs 7 disposed between the seat carrier and the tiltable member 3. The seat carrier 6 is connected to the tiltable member 3 by means of a parallelogrammic linkage mechanism 10, so that the seat carrier is movable up and down relative to the tiltable member.

The parallelogrammic linkage mechanism 10 comprises a pair of front links 8 and a pair of rear links 9. The front links 8 and the rear links 9 have their upper ends pivotally connected by upper pins 11 to an elongate block 12 which is fixed to the underside of the seat carrier 6. Intermediate bent portions of the front links 8 and the lower ends of the rear links 9 are pivotally connected by lower pins 13 to upturned brackets 14 of the tiltable member 3. The lower pins 13 are located behind the upper pins 11. Thus, when the weight of the sitter is applied to the seat S, the seat carrier 6 moves downward and forward due to the function of the parallelogrammic linkage mechanism 10.

The tiltable member 3 is tiltable downward by pivoting about the lateral support shaft 4 against the biasing force of two tilting control springs 16. The combined spring constant of the two tilting control springs 16 is larger than the summed spring constant of all the weight responsive springs 7.

Figure 2:
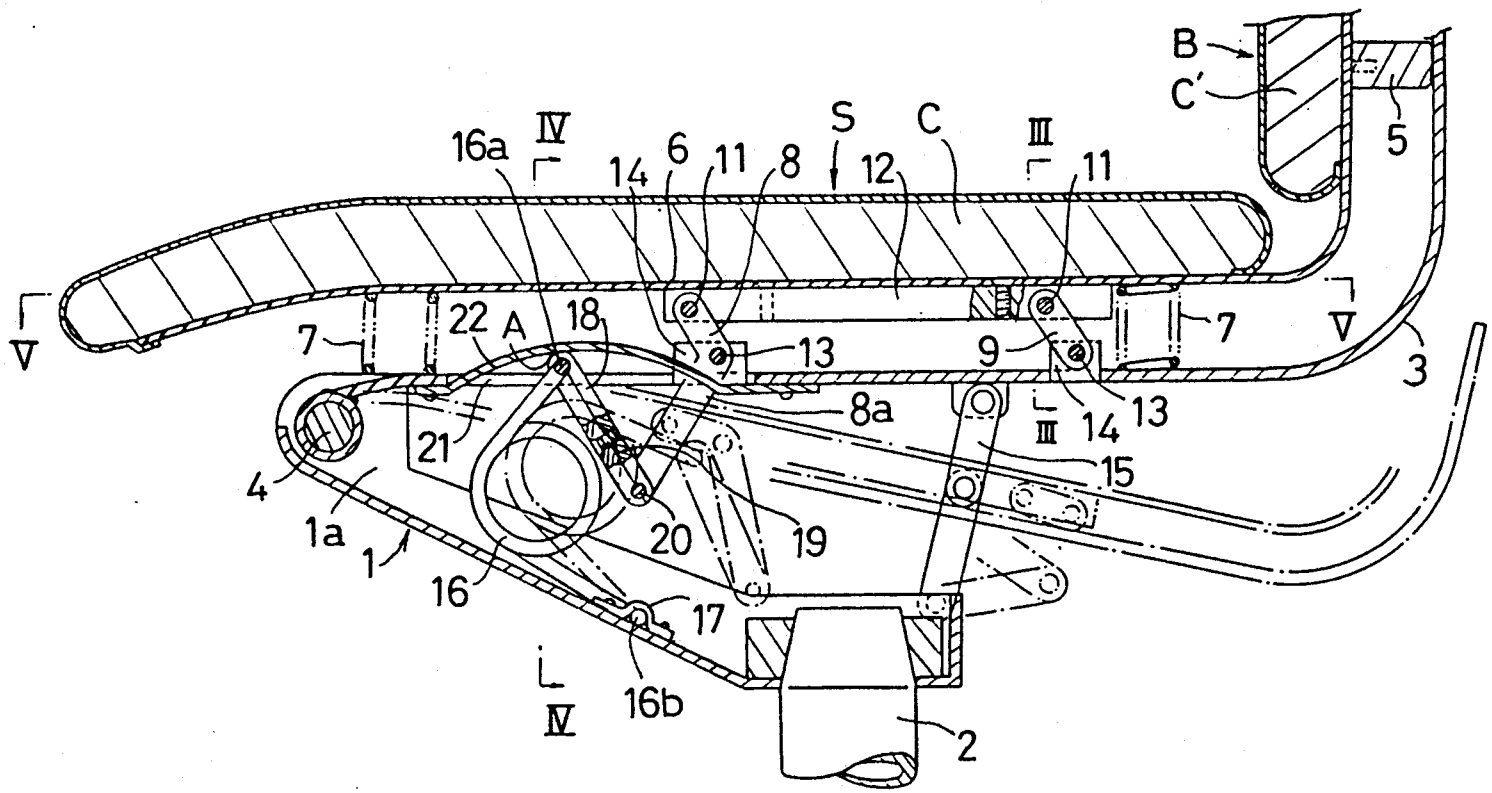
FIG. 2 is a sectional view taken on lines II—II in FIG. 1.
Figure 4:
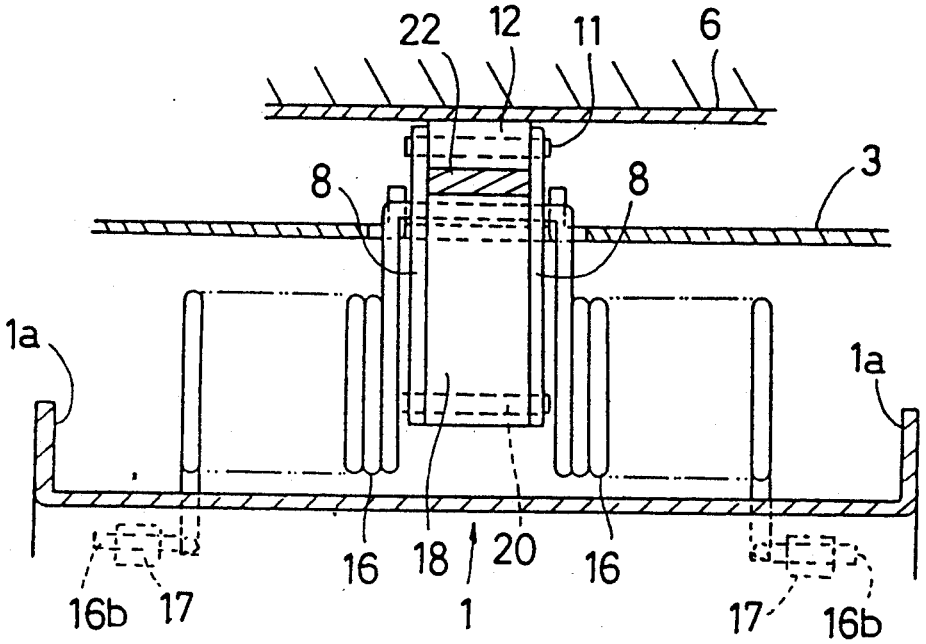
FIG. 4 is a fragmentary sectional view taken along lines IV—IV in FIG. 2.
Figure 3:
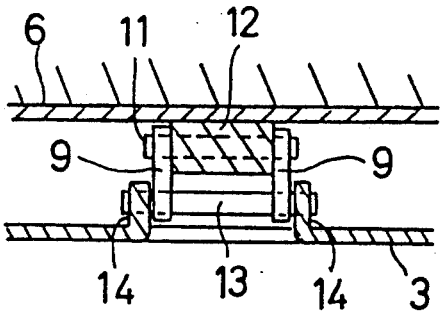
FIG. 3 is a sectional view taken along lines III—III in FIG. 2.
Figure 6:
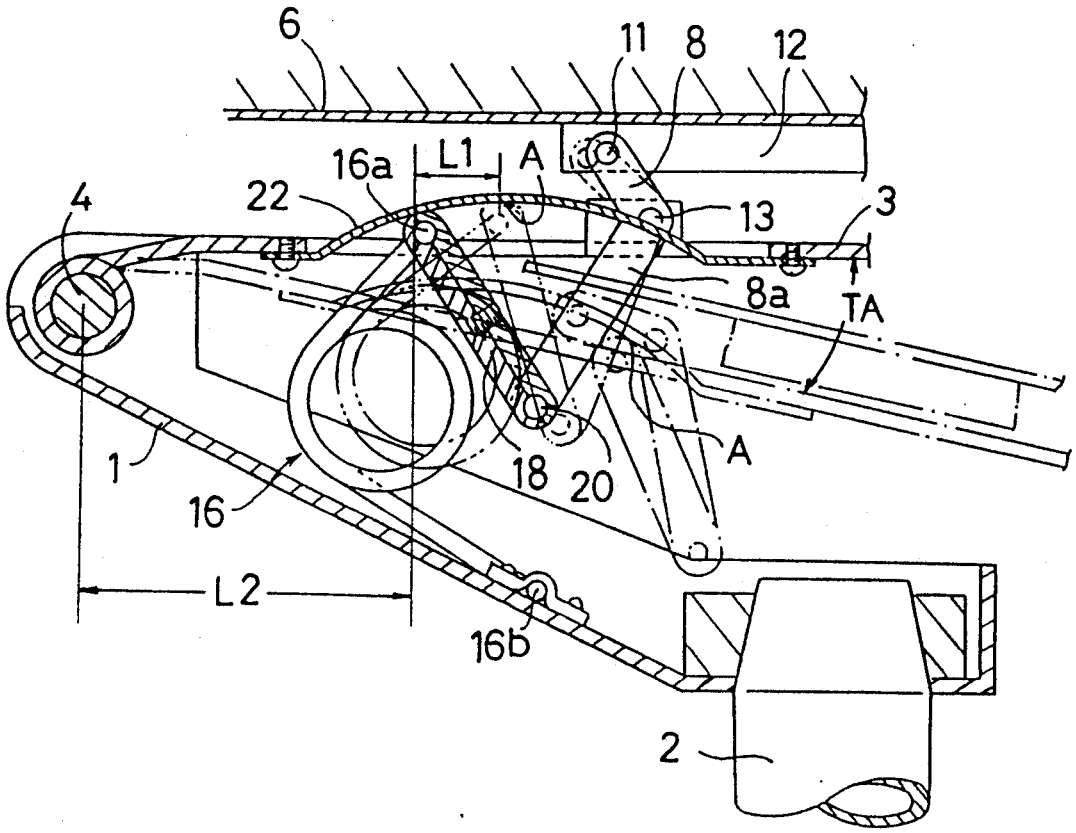
FIG. 6 is a fragmentary sectional view similar to FIG. 2 for showing the operation of the rocking chair according to the first embodiment.
Figure 5:
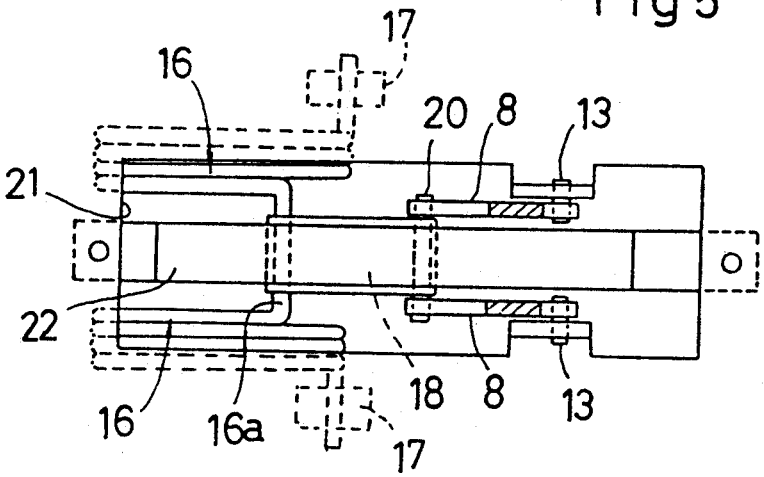
FIG. 5 is a sectional view taken on lines V—V in FIG. 2.

Upward pivoting of the tiltable member 3 is limited by a restraining link assembly 15 see FIG. 2) which is articulated at an intermediate portion thereof and pivotally connected at both ends to the tiltable member and the fixed frame 1. The tiltable member assumes the substantially horizontal position when the restraining link assembly 15 is fully extended, as shown in FIG. 2.

Each of the illustrated tilting control springs 16 is a torsional coil spring which has an upper end 16*a* extending rearwardly from the coiled portion. The torsional coil spring 16 also has a lower end which extends rearwardly from the coiled portion to be pivotally connected to the fixed frame 1 by a retainer 17. As appreciated from FIGS. 4 and 6, the upper end 16*a* of one torsional coil spring is integral with the upper end of the other torsional coil spring.

The position of the integral upper end 16*a* of the two torsional coil springs (tilting control springs) relative to the tiltable member 3 is forcibly varied in response to downward movement of the seat S by means of a motion converting means. According to the first embodiment, this motion converting means comprises the parallelogrammic linkage mechanism 10 as well as the following elements.

Specifically, the motion converting means of the first embodiment further includes a pull link 18 which consists of divided half plates joined together by a screw 19, whereas each front link 8 of the parallelogrammic linkage mechanism 10 has a lower extension 8*a*. The pull link 18 has a forward (upper) end pivotally connected to the integral upper end 16*a* of the two torsional coil springs 16. The pull link further has a rearward (lower) end pivotally connected to the lower extension 8*a* of the front link 8 by a pin 20.

The tiltable member 3 has an elongate opening 21 at a position substantially corresponding to the pull link 18. The front link lower extensions 8*a* of the parallelogrammic linkage mechanism 10 extend downward through the elongate opening 21. An arcuate or upwardly convex sliding contact member 22 is mounted to the tiltable member 3 at the elongate opening 21 and extends between the front link lower extensions 8*a* of the parallelogrammic linkage mechanism. The forward (upper) end of the pull link 18 is held in sliding contact with the underside of the contact member 22.

With the arrangement described above, when the weight of the sitter is applied to the seat S, the seat carrier 6 is lowered and moved slightly forward to deform the parallelogrammic linkage mechanism 10 against the weight responsive springs 7. As a result, the front link lower extensions 8*a* of the parallelogrammic linkage mechanism are pivoted to rearwardly pull the integral upper end 16*a* of the torsional coil springs 16 via the pull link 18. Thus, the torsional springs 16 pivot rearward about the rearward ends 16*b* while the pull link 18 also displaces rearward in sliding contact with the contact member 22, as indicated by two-dot chain lines in FIG. 6.

Downward displacement of the seat S occurs against the weight responsive springs 7, so that the amount of such downward displacement is generally proportional to the weight of the sitter. The pull link 18 provides a spring acting point (support point) A (see FIGS. 2 and 6) for the tiltable member 3, and rearward displacement of the spring acting point A occurs in response to pivotal movement of the front links 8 which accompanies downward displacement of the seat S. Thus, the amount L1 (FIG. 6) of rearward displacement of the spring acting point A from the initial position is also generally or roughly proportional to the sitter's weight.

Obviously, the rearward displacing amount L1 of the spring acting point A is larger for a heavier sitter than for a lighter sitter. In other words, the distance L2 between the spring acting point A and the lateral support shaft 4 is larger for a heavier sitter than for a lighter sitter.

On the other hand, the rearward displacing amount L1 remains generally constant for sitters of the substantially same weight. Further, the position of the spring acting point A relative to the sliding contact member 22 (namely, the tiltable member 3) remains substantially unchanged for a given sitter.

Strictly speaking, because the lateral support shaft 4 is located closer to the front end of the seat S, the tiltable member 3 tilts slightly downward when the user sits on the seat S even if the user does not apply any leaning load onto the chair back B. However, such initial tilting of the tiltable member 3 may be virtually avoided simply if the lateral support shaft 4 for the tiltable member is located generally at the middle between the front and rear ends of the seat S. Thus, the initial tilting of the tiltable member is considered insignificant, and therefore disregarded for the convenience of the following description.

When the sitter applies a leaning load onto the chair back B, the tiltable member 3 tilts downward by pivoting about the lateral support shaft 4. The tilting control springs 16, which have been correspondingly deformed, support the tiltable member 3 at the spring acting point A.

For a given tilting angle TA (see FIG. 6) of the tiltable member 3, the degree of torsional deformation of the tilting control springs 16 increases as the distance L2 between the lateral support shaft 4 and the spring acting point A increases. As described above, the distance L2 is larger for a heavier sitter than for a lighter sitter because the position of the spring acting point A displaces rearward in substantially proportional relation to the sitter's weight. Thus, the reaction force of the tilting control springs 16 for the given tilting angle TA is larger for a heavier sitter than for a lighter sitter.

Further, for supporting a given leaning load, the reaction moment resulting from the tilting control springs 16 must be equal to the moment resulting from the given leaning load. The reaction moment of the tilting control springs is a product of the spring force and the distance L2 (reaction moment arm length). Thus, the reaction moment increases as the reaction moment arm length L2 increases in substantially proportional relation to the sitter's weight.

In summary, the displacement of the spring acting point A not only leads to adjustment of the spring force itself but also adjustment of the reaction moment arm length L2. As a net result of such adjustment, the tilting control springs 16 provide a softer leaning support for a lighter sitter, but a harder leaning support for a heavier sitter. In other words, the tilting control springs 16 are automatically adjusted in tilting control ability to suit the weight of the sitter. Thus, any sitters can enjoy a similar tilting feel.

As described above, the illustrated sliding contact member 22 is arcuate or upwardly convex. Such a configuration of the contact member is preferred because unintended torsioning of the tilting control springs 16 is prevented or reduced when the integral spring upper end 16*a* is displaced rearward. Obviously, the tilting control springs 16 are torsioned if the integral upper end 16*a* approaches the spring lower ends 16*b*. The arcuate contact member 22 insures that the integral upper end 16*a* is located substantially at a constant distance from the spring lower ends 16*b* when displacing rearward along the arcuate contact member 22 (see FIG. 6). In this way, the integral upper end 16*a* or the pull link 18 can displace smoothly rearward with a minimum friction against the arcuate contact member 22.

According to the first embodiment illustrated in FIGS. 1 through 6, the upper and lower ends 16*a*, 16*b* of each tilting control spring 16 are directed rearwardly. However, it is apparent that both ends of the tilting control spring may be directed forwardly.

Figure 7:
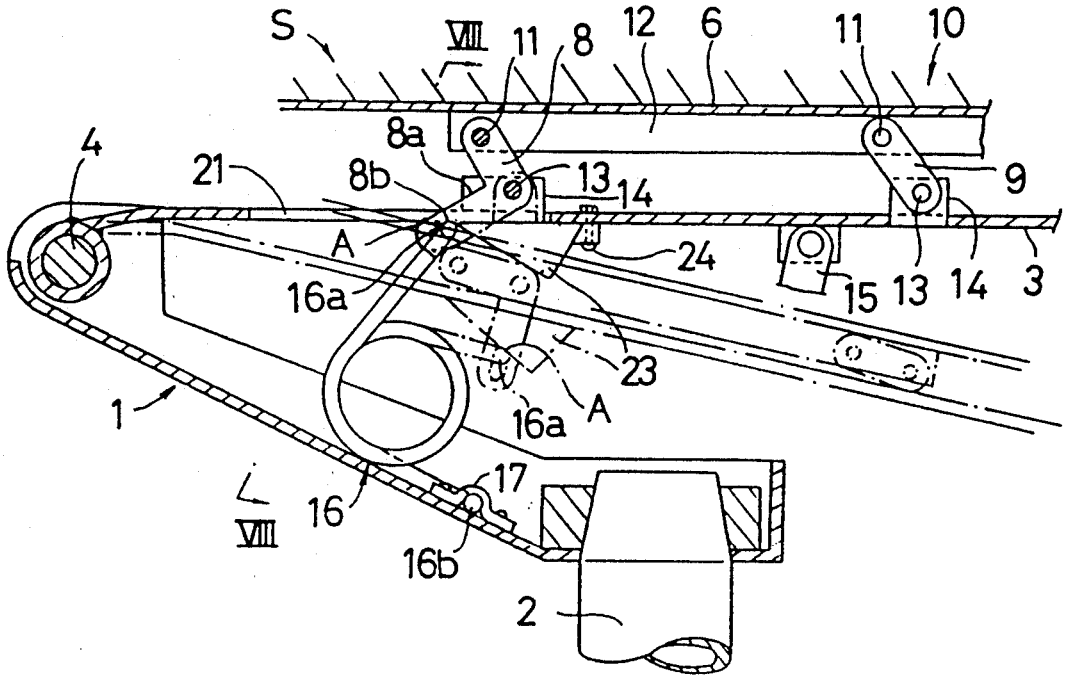
FIG. 7 is a fragmentary sectional view showing a rocking chair according to a second embodiment of the present invention.
Figure 8:
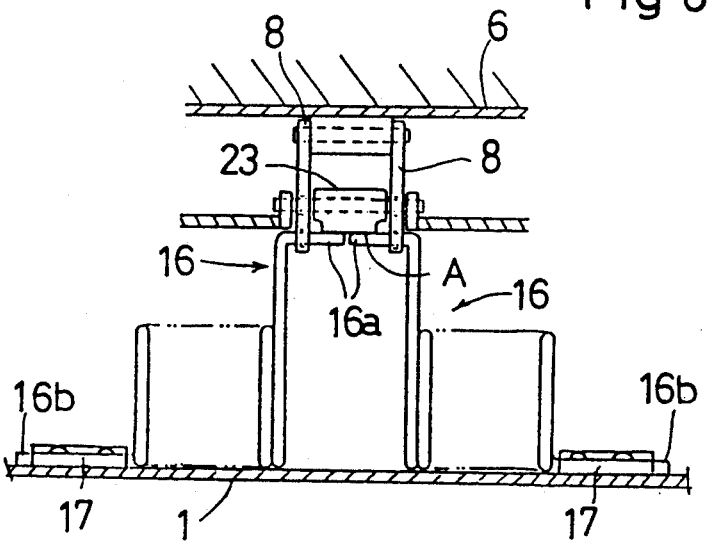
FIG. 8 is a sectional view taken on lines VIII—VIII in FIG. 7.

FIGS. 7 and 8 show a second embodiment which differs from the first embodiment only in the following respects.

First, the torsional coil springs 16 as tilting control springs respectively have upper ends 16*a* which are separate from each other (see FIG. 8), as opposed to those of the first embodiment. However, this structural difference does not result in any functional difference.

Second, the lower extension 8*a* of each front link 8 of the parallelogrammic linkage mechanism 10 is directly connected pivotally to the upper end 16*a* of the corresponding tilting control spring 16. The lower extension 8*a* has an elongated hole 8*b* for movably receiving the spring upper end 16*a*.

Third, the arcuate sliding contact member 22 of the first embodiment is replaced by a wedge-like sliding contact member 23 mounted to the underside of the tiltable member 3 by means of a bolt 24. The wedge-like contact member 23 comes into sliding contact with the upper 16*a* of each tilting control spring 16.

When the user sits on the seat S, the lower extension 8*a* of each front link 8 of the parallelogrammic linkage mechanism 10 is pivoted to displace the corresponding spring upper end 16*a* rearwardly along the wedge-like contact member 23. Obviously, the degree of such rearward displacement increases as the weight of the sitter increases. Thus, the rocking chair according to the second embodiment operates substantially in the same way as that of the first embodiment.

Figure 9:
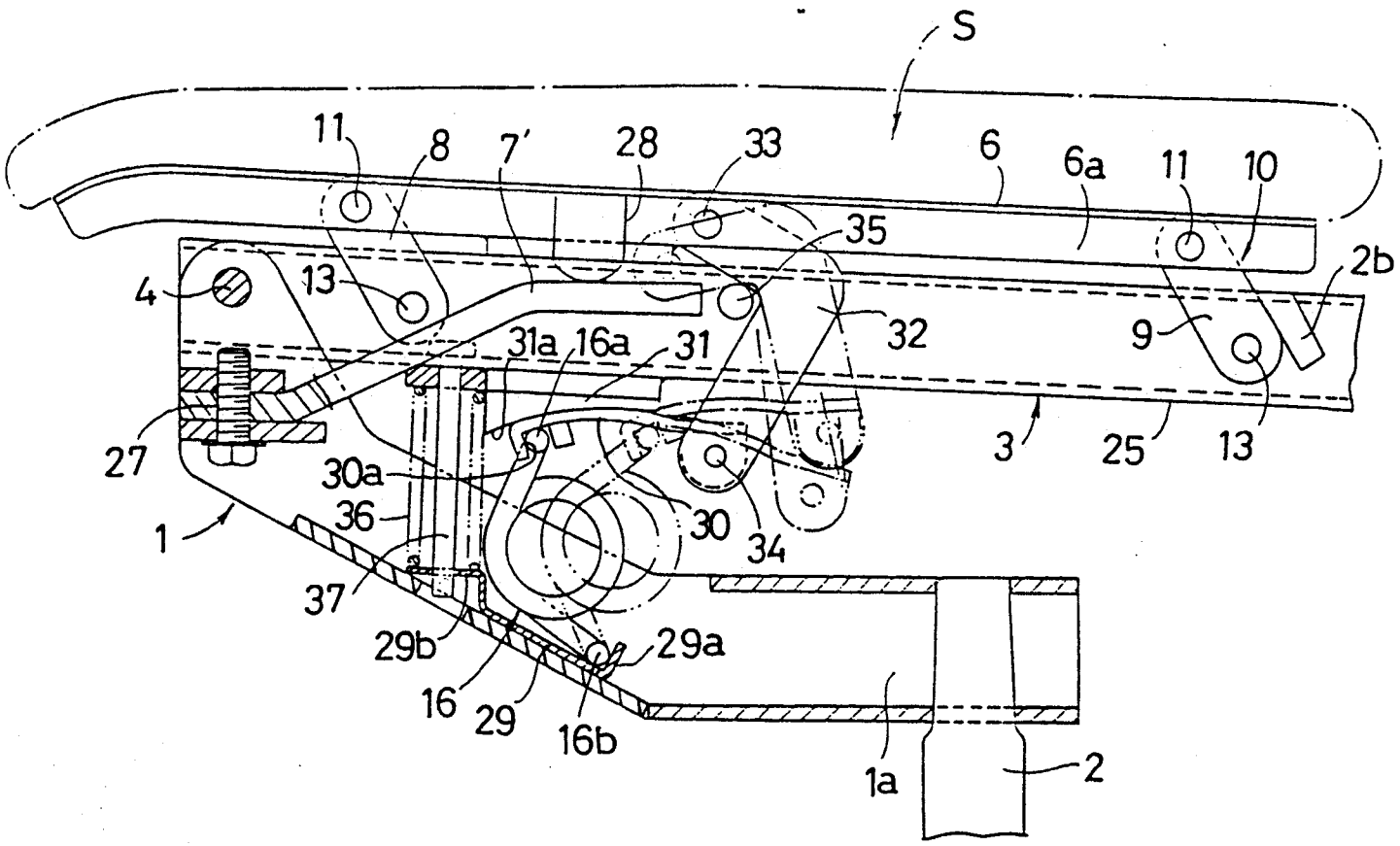
FIG. 9 is a fragmentary sectional view showing a rocking chair according to a third embodiment of the present invention.
Figure 10:
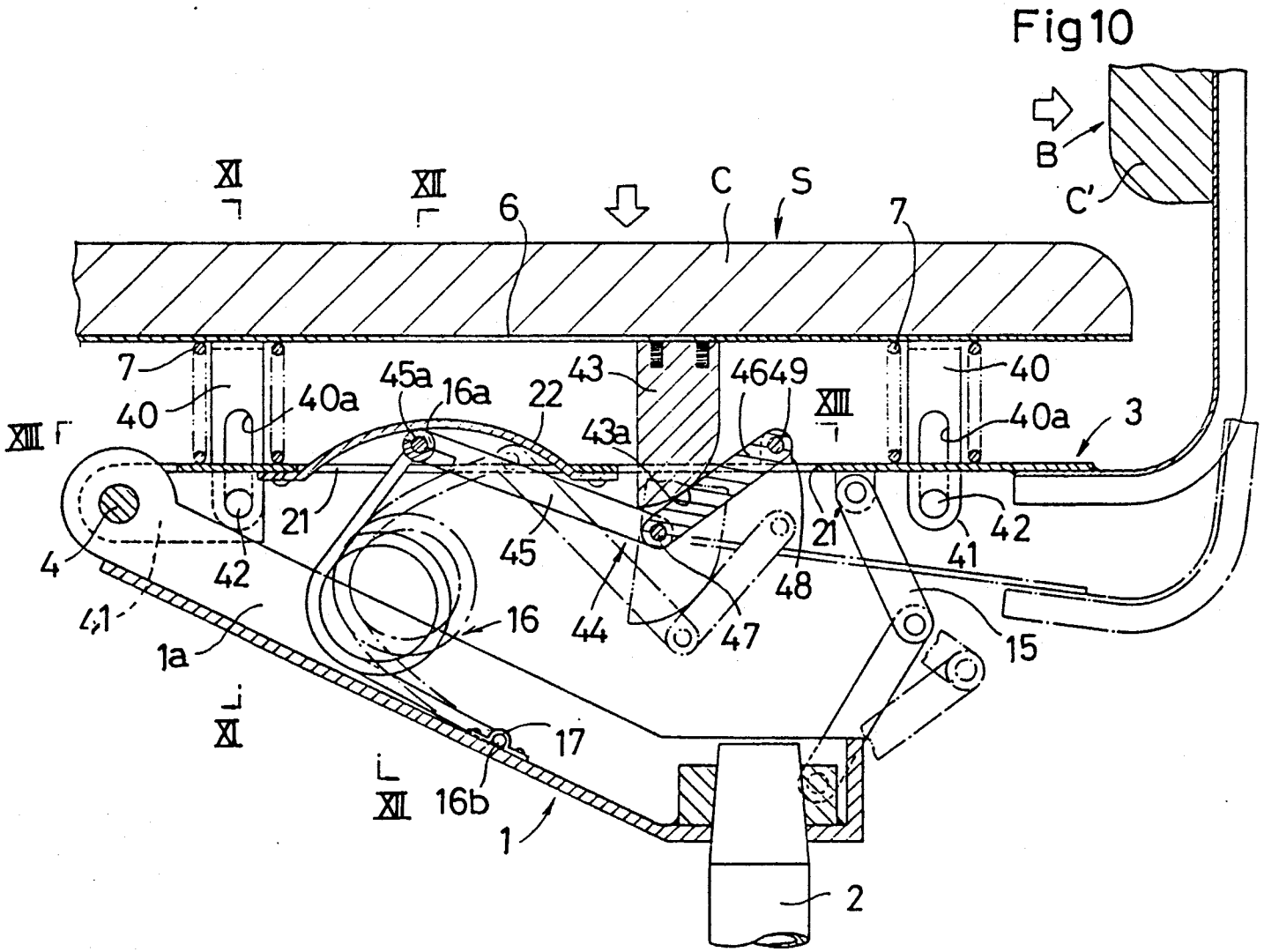
FIG. 10 is a sectional side view showing a rocking chair according to a fourth embodiment of the present invention.
Figure 11:
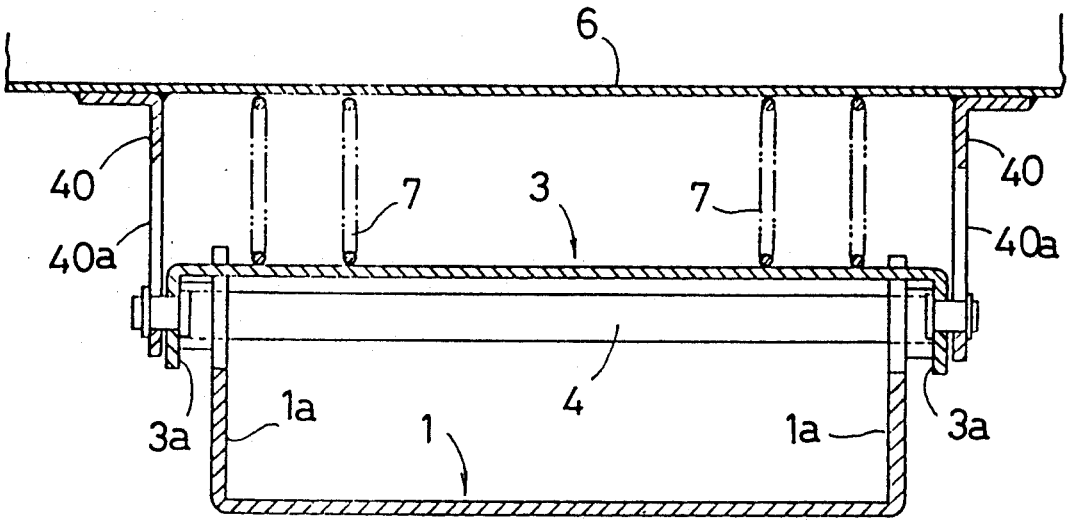
FIG. 11 is a sectional view taken along lines XI—XI in FIG. 10.
Figure 12:
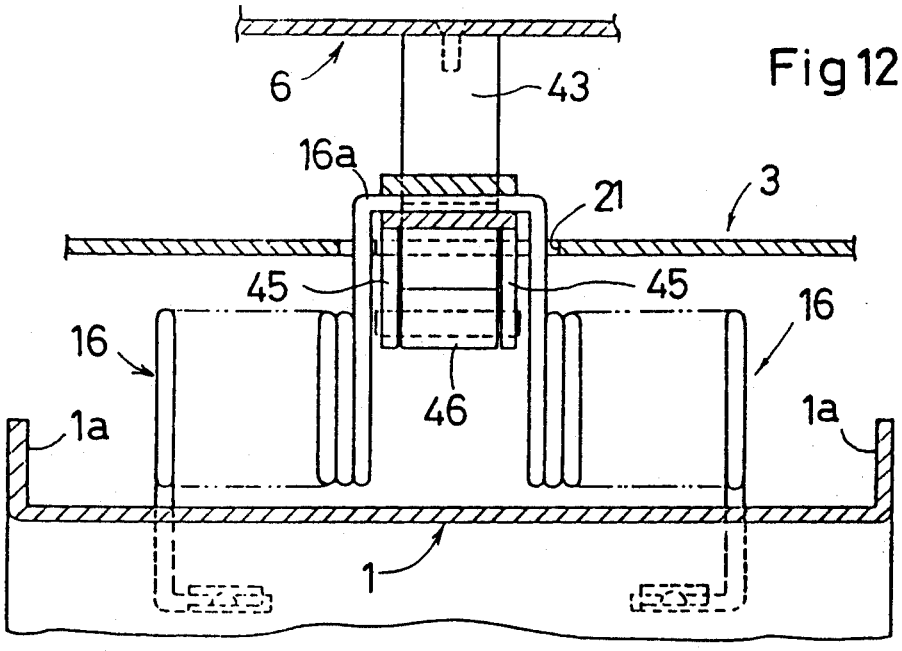
FIG. 12 is a sectional view taken along lines XII—XII in FIG. 10.

FIG. 9 shows a rocking chair according to a third embodiment of the present invention. This rocking chair comprises a fixed frame 1 mounted to the upper end of a chair leg post 2, a tiltable member 3 pivotally connected to the fixed frame 1 by means of a lateral support shaft 4, and a seat carrier 6 for receiving a seat S.

According to the third embodiment, the tiltable member 3 is in the form of a frame including a pair of side bars 25 (only one shown). Each side bar has an unillustrated upright portion for receiving an unillustrated chair back.

The seat carrier 6 of the third embodiment has a pair of downturned side flanges 6*a* (only one shown), and is used to receive the seat S alone because the unillustrated chair back is received by the tiltable member 3. The seat carrier 6 is connected to the tiltable member 3 by means of a parallelogrammic linkage mechanism 10 which includes a pair of front links 8 (only one shown) and a pair of rear links 9 (only one shown), so that the seat carrier 6 is movable toward and away from the tiltable member 3.

Specifically, the front and rear links 8, 9 of the parallelogrammic linkage mechanism 10 are pivotally connected to the side flanges 6*a* of the seat carrier 6 by means of upper pins 11, and to the side bars 25 of the tiltable member 3 by means of lower pins 13. The lower pins 13 may extend between the side bars 25 to constitute the framework of the tiltable member 3. Each side bar 25 is provided with a fixed stopper 26 for preventing the corresponding rear link 9 from excessively pivoting upward, thereby insuring that the seat carrier 6 displaces forwardly downward but not rearwardly downward.

At the front end of the fixed frame 1 is provided a leaf spring 7' fixed by a bolt 27 in a cantilever fashion. The leaf spring 7', which serves as a weight responsive spring, extends rearwardly upward.

The underside of the seat carrier 6 is provided with a bearing projection 28 which rests on the leaf spring 7' in sliding contact therewith. Thus, the seat carrier 6 (namely, the seat S thereon) is always urged upward by the leaf spring 7', but allowed to lower against the biasing force of the leaf spring when the weight of the sitter is applied to the seat.

A pair of torsional coil springs 16 (only one shown) as tilting control springs are similar in configuration to those of the first embodiment, but received on a spring bearing 29. The lower ends 16*b* of the torsional springs are pivotally supported at a rear corner portion 29*a* of the spring bearing.

The integral upper end 16*a* of the torsional coil springs 16 is pivotally received in a front receptacle portion 30*a* of a generally arcuate or upwardly convex slide link 30. The slide link is held in sliding contact with an arcuate or upwardly convex contact surface 31*a* of a sliding contact member 31 which is attached to the underside of the tiltable member 3.

An L-shaped link 32 has an upper end pivotally connected to the side flanges 6*a* of the seat carrier 6 by a pin 33, and a lower end pivotally connected to the rear end of the slide link 30. Near the intermediate bent portion, the L-shaped link 32 rests on a cross pin 35 extending between the side bars 25 of the tiltable member 3.

Indicated at 36 is an auxiliary spring to assist the function of the tilting control springs 16. However, no adjustment occurs with respect to the auxiliary spring 36 itself. Indicated at 37 is a restraining pin for preventing the tiltable member 3 from pivoting upward beyond its horizontal position.

According to the arrangement of the third embodiment, when the weight of the sitter is applied to the seat S, the seat carrier 6 is moved downwardly forward against the weight responsive spring 7'. As a result, the cross pin 35 kicks up the L-shaped link 32 to cause rearward pivoting thereof, consequently pulling the slide link 30 to cause rearward displacement of the integral upper end 16*a* of the tilting control springs 16, as indicated by phantom lines in FIG. 9.

Obviously, the rearward displacement of the integral upper end 16*a* of the tilting control springs 16 is roughly proportional to the weight of the sitter. Thus, for the reasons already described in connection with the first embodiment, the tilting control springs 16 are automatically adjusted to provide a harder tilting support for a heavier sitter but a softer tilting support for a lighter sitter.

FIGS. 10 through 13 show a fourth embodiment of the present invention which is similar to the first embodiment. To avoid repetition, those parts substantially common for these two embodiments are regarded as already described. The fourth embodiment differs from the first embodiment in the following respects.

The seat carrier 6 receives only the seat S. Instead, the tiltable member 3 has an upright portion for receiving the chair back B.

The underside of the seat carrier 6 is provided with front and rear pairs of vertically extending guide brackets 40 each of which has a vertically elongated guide slot 40*a*. On the other hand, the tiltable member 3 has front and rear pairs of downturned brackets 41 in corresponding relation to the guide brackets 40 for supporting slide pins 42 each of which is inserted in the elongated guide slot 40*a* of the corresponding guide bracket. Thus, the seat carrier 6 together with the seat S thereon is vertically movable toward and away from the tiltable member 3.

The underside of the seat carrier 6 is further provided with a presser member 43 having a downwardly convex arcuate pressing surface 43*a*. The presser member 43 penetrates through an auxiliary opening 21' formed in the tiltable member 3.

The integral upper end 16*a* of the tilting control torsional springs 16 is connected to an pull link assembly 44. Specifically, the pull link assembly 44 includes a pair of front pull links 45 and a rear pull link 46. The respective forward ends of the front pull links 45 are joined together by a cylindrical portion 45*a* which is rotatably fitted on the integral upper end 16*a* of the tilting control springs. The rearward ends of the front pull links 45 are pivotally connected to the forward end of the rear pull link 46 by means of a pin 47. The rearward end of the rear pull link 46 is pivotally connected to a pair of upturned brackets 48 on both sides of the auxiliary opening 21' by means of another pin 49.

The rear pull link 46 is arranged in a manner such that it comes into sliding contact with the arcuate pressing surface 43*a* of the presser member 43. Preferably, the cylindrical portion 45*a* at the forward ends of the front pull links 45 consists of two cylindrical halves which are joined together as by welding or bolting after the integral upper end 16*a* of the tilting control springs 16 are sandwiched therebetween.

According to the arrangement of the fourth embodiment, when the weight of the sitter is applied to the seat S, the seat carrier 6 is moved vertically downward against the weight responsive springs 7. As a result, the presser member 43 acts to pivot down the rear pull link 46, thereby pulling the integral upper end 16*a* of the tilting control springs 16 rearwardly along the arcuate sliding contact member 22 via the front pull links 45.

Obviously, the rearward displacement of the integral upper end 16*a* of the tilting control springs 16 is roughly proportional to the weight of the sitter. Thus, for the reasons already described in connection with the first embodiment, the tilting control springs 16 are automatically adjusted to provide a harder tilting support for a heavier sitter but a softer tilting support for a lighter sitter.

Figure 14:
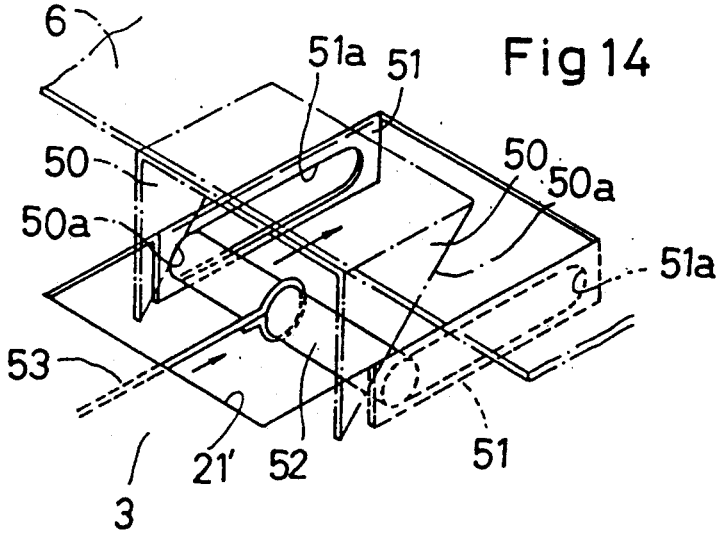
FIG. 14 is a fragmentary perspective view showing a principal portion of a rocking chair according to a fifth embodiment of the present invention.

FIG. 14 illustrates a fifth embodiment which is obtained by modifying the fourth embodiment (FIGS. 10 to 13) in the following manner.

The underside of the seat carrier 6 is provided with a pair of presser members 50 insertable into the auxiliary opening 21' of the tiltable member 3. Each presser member 50 has a cam surface 50*a* which is inclined forwardly downward.

The underside of the tiltable member 3 is provided, on both sides of the auxiliary opening 21', with a pair of downturned brackets 51 each having a horizontally elongated guide slot 51*a*. A slide pin 52 is slidably received in the guide slots 51*a* of the brackets 51 and held in contact with the cam surfaces 50*a* of the presser members 50. The slide pin 52 is connected to the integral upper end 16*a* (see FIG. 10) of the tilting control springs 16 via a pull wire 53.

Obviously, the slide pin 52 is displaced rearward to rearwardly pull the integral upper end 16*a* of the tilting control springs 16 when the seat carrier 6 lowers under the weight of the sitter. Thus, the tilting control springs 16 are automatically adjusted in tilting support ability to suit the sitter's weight.

In either of the fourth and fifth embodiments, the presser member or members 43, 50 may be arranged on the tiltable member 3 to project upwardly, whereas the brackets 48, 51 for the pull link assembly 44 or the slide pin 52 may be mounted to the underside of the seat carrier 6.

Figure 16:
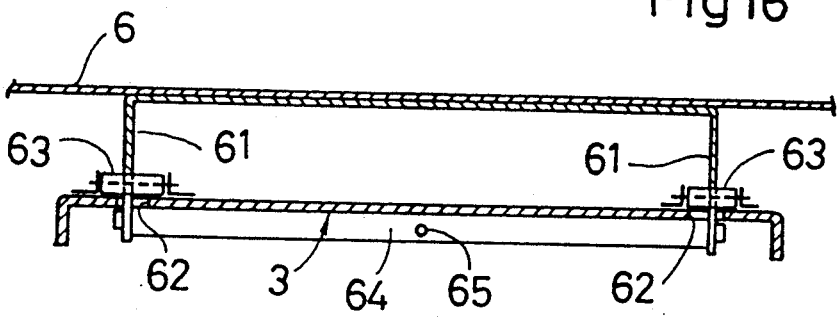
FIG. 16 is a sectional view taken along lines XVI—XVI in FIG. 15.
Figure 13:
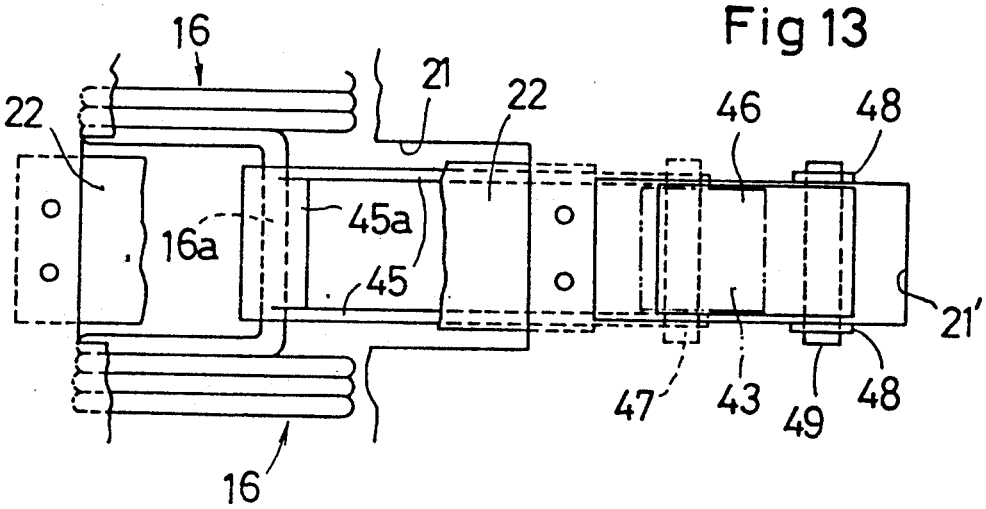
FIG. 13 is a sectional view taken on lines XIII—XIII in FIG. 10.
Figure 15:
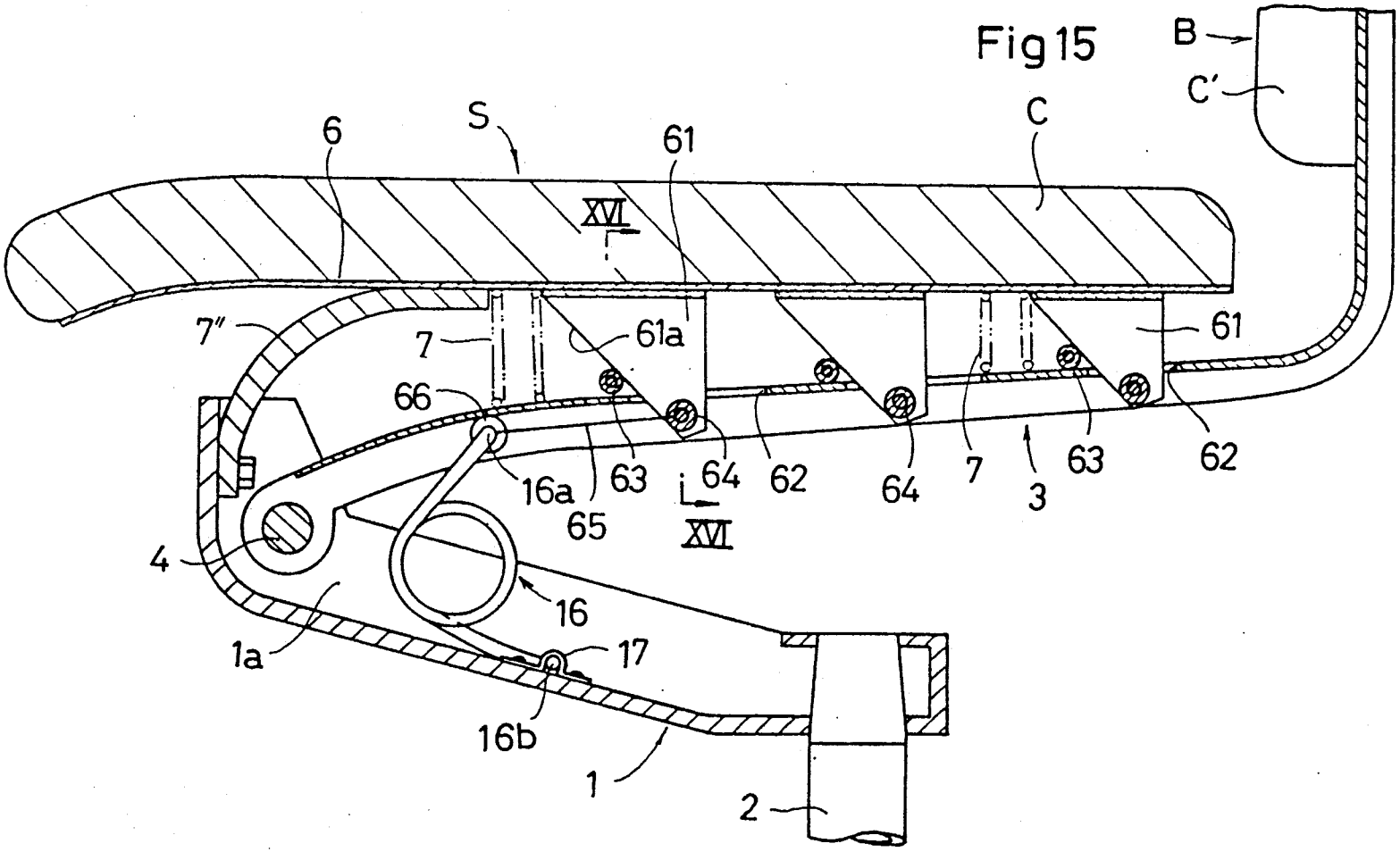
FIG. 15 is a sectional side view showing a rocking chair according to a sixth embodiment of the present invention.
Figure 17:
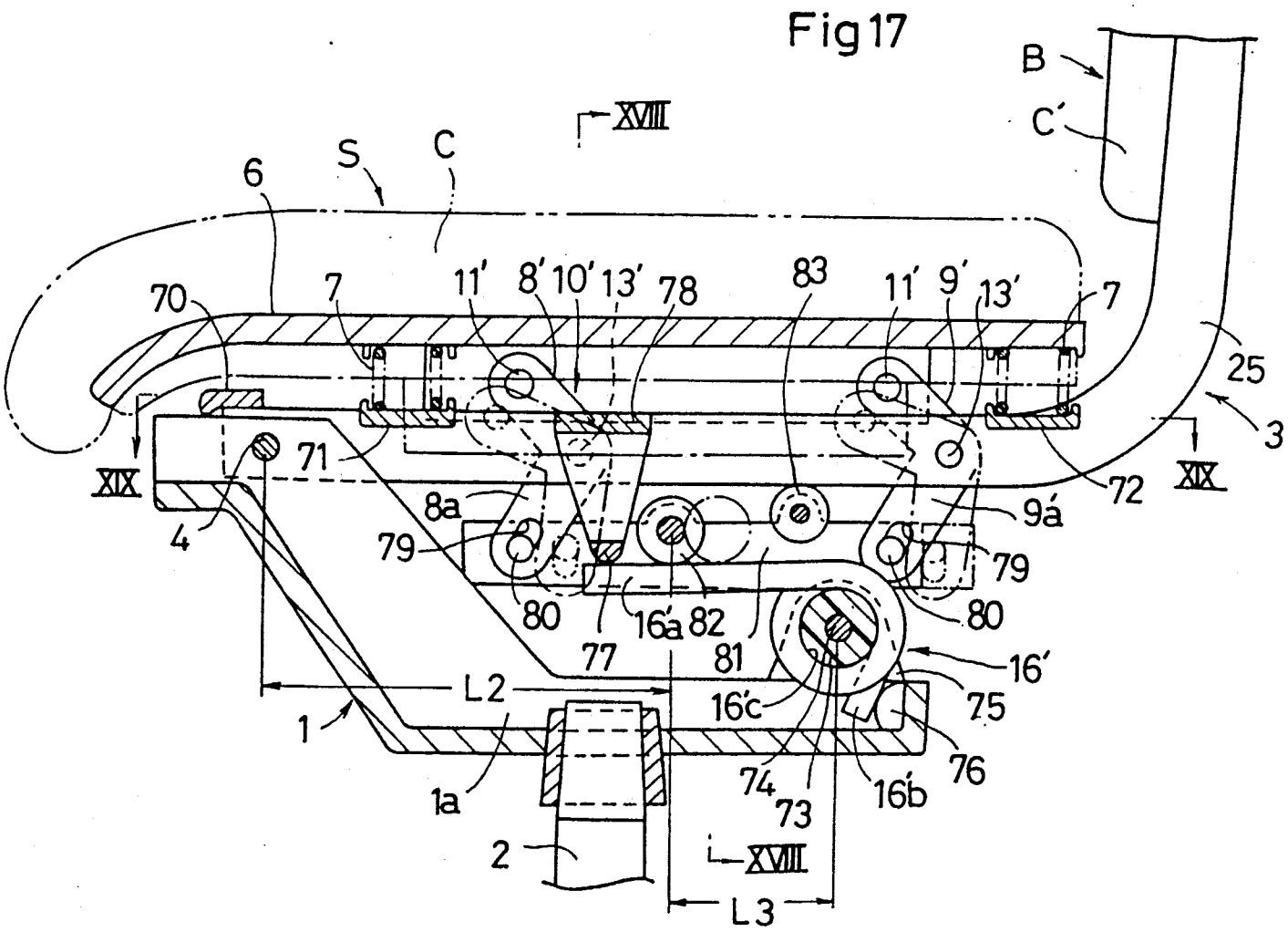
FIG. 17 is a sectional side view showing a rocking chair according to a seventh embodiment of the present invention.

FIGS. 15 and 16 show a rocking chair according to a sixth embodiment of the present invention wherein a leaf spring 7'' as a weight responsive spring has a forward end fixed to the front end of the fixed frame 1. The leaf spring 7'' extends rearwardly upward to be fixed at its rearward end to the seat carrier 6. Thus, when the leaf spring 7'' is elastically deformed under the weight of the sitter, the seat carrier 6 is displaced downwardly rearward.

The underside of the seat carrier 6 is provided with pairs of downwardly directed side guide members 61 at suitable spacing in the back-and-forth direction of the chair. Each guide member 61 has a guide surface 61*a* which is inclined to extend rearwardly downward.

The tiltable member 3 is formed with pairs of passage openings 62 to allow penetration therethrough of the guide members 61. Further, the upper side of the tiltable member 3 rotatably supports pairs of guide rollers 63 which come into contact with the guide surfaces 61*a* of the guide members 61.

A restraining rod 64 extends between each pair of guide members 61 to engage the underside of the tiltable member 3. Thus, the guide members 61 are prevented from moving upward out of the passage openings 62.

The foremost restraining rod 64 is connected to the integral upper end 16*a* of the tilting control torsional springs 16 via a pull wire 65. Further, a cylindrical slider 66 is fitted over the integral upper end 16*a* of the tilting control springs 16 to come into sliding contact with the underside of the tiltable member 3.

According to the arrangement of the sixth embodiment, when the weight of the sitter is applied to the seat S, the seat carrier 6 is moved downwardly rearward against the weight responsive leaf spring 7''. As a result, the integral upper end 16*a* of the tilting control springs 16 is pulled rearward via the pull wire 65.

Obviously, the rearward displacement of the integral upper end 16*a* of the tilting control springs 16 is roughly proportional to the weight of the sitter. Thus, for the reasons already described in connection with the first embodiment, the tilting control springs 16 are automatically adjusted to suit the weight of the sitter.

The guide members 61 of the sixth embodiment shown in FIGS. 15 and 16 may be arranged on the tiltable member 3. Further, instead of supporting the seat carrier 6 by the leaf spring 7'', the seat carrier 6 may be supported on the tiltable member 3 via weight responsive compression coil springs 7 (see FIG. 15), and connected to the tiltable member by means of a guide means (not shown) which enables the seat carrier to move downwardly rearward under the weight of the sitter.

FIGS. 17 through 20 show a rocking chair according to a seventh embodiment. To avoid duplicated explanation, the following description is directed to those points which are specific only to the seventh embodiment.

The tiltable member 3 is in the form of a frame which comprises a pair of side bars 25 each having an upright portion for receiving the chair back B. The side bars 25 are connected together by a stopper cross bar 70, a front spring bearing cross bar 71, and a rear spring bearing cross bar 72. The stopper cross bar 70 comes into engagement with the front end of the fixed frame 1 from above to prevent the tiltable member 3 from pivoting upward beyond its horizontal position while allowing downward tilting thereof. The front and rear spring bearing cross bars 71, 72 support the weight responsive compression springs 7.

Downward tilting of the tiltable member 3 is controlled by a pair of tilting control torsional coil springs 16'. Each tilting control spring 16' has a coiled portion 16c' loosely fitted on a cylindrical elastic member 73 which is in turn fitted on a lateral shaft 74. The lateral shaft 74 is supported by a pair of side mount brackets 75 provided at the rear end of the fixed frame 1.

Each tilting control spring 16' further has upper and lower ends 16a', 16b' projecting tangentially from the coiled portion 16c'. In the FIG. 17 state of the tilting control spring, the upper end 16a' extends forward substantially horizontally from the coiled portion 16c'. The lower end 16b' extends downward and is always held in engagement with a pair of abutment members 76 fixedly mounted to the rear end of the fixed frame 1.

A restraining projection 77 extends downward from a mount cross bar 78 to rest on the upper ends 16a' of the tilting control springs 16'. The restraining projection 77 serves to hold the tiltable member 3 substantially horizontal when the user sits on the seat S. The restraining projection 77 further works to kept constant the distance between the tiltable member 3 and the upper ends 16a' of the tilting control springs as long as the projection 77 contacts the spring upper ends. The mount cross bar 78 is also used to connect between the side bars 25 of the tiltable member 3.

Figure 18:
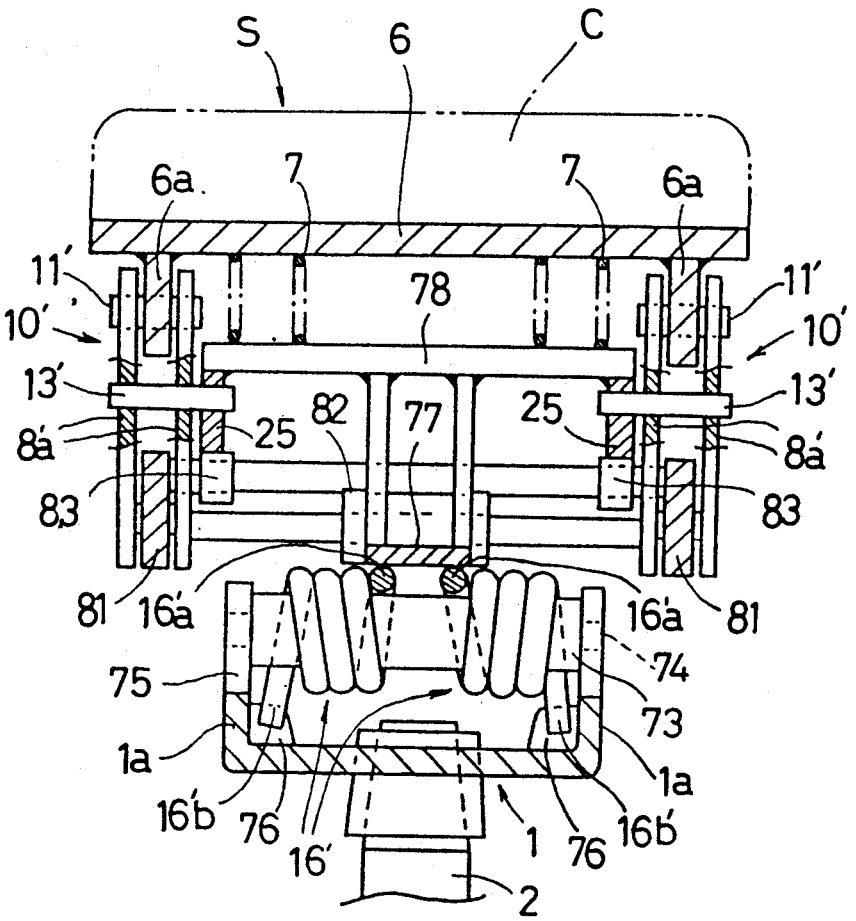
FIG. 18 is a sectional view taken along lines XVIII—XVIII in FIG. 17.
Figure 19:
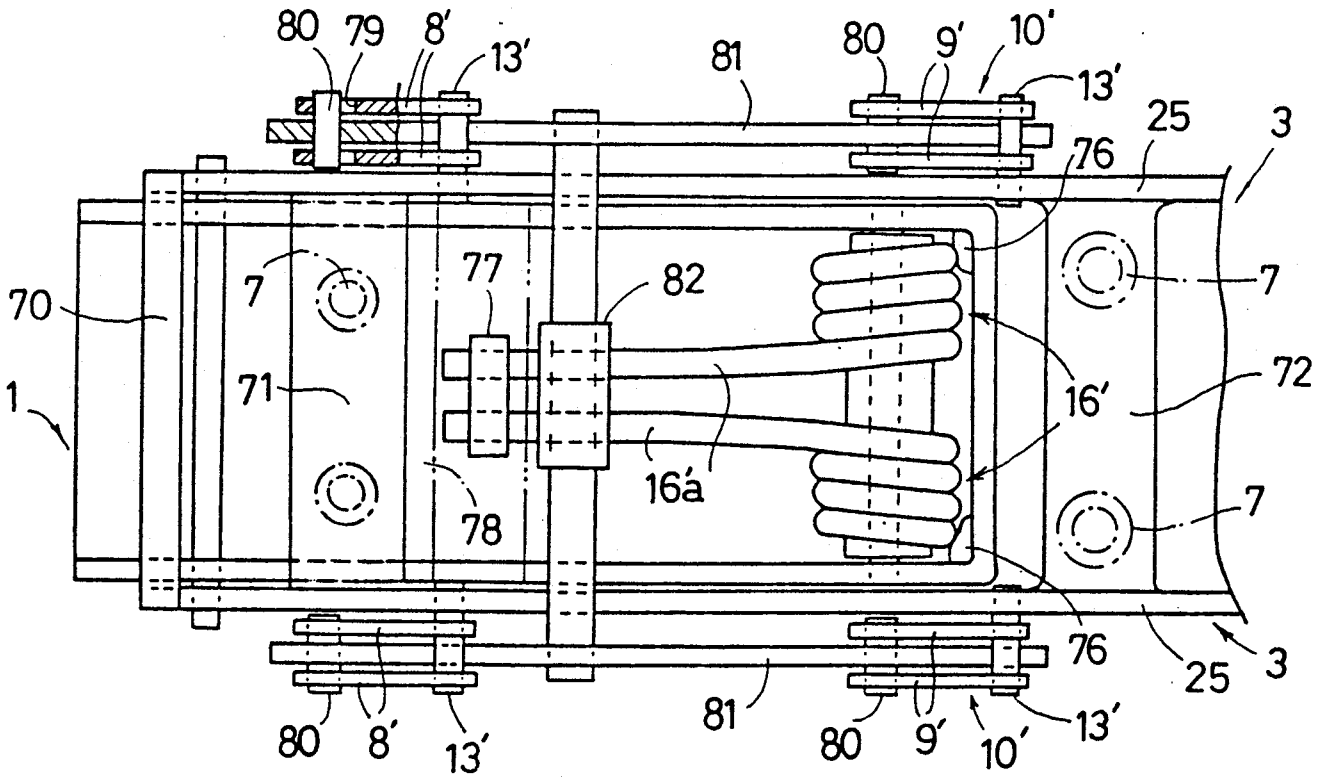
FIG. 19 is a sectional view taken along lines XIX—XIX in FIG. 17.

The seat carrier 6 having a pair of side flanges 6a is connected to the tiltable member 3 by a pair of parallelogrammic linkage mechanisms 10' arranged on both sides of the tiltable member (see FIGS. 18 and 19). Each parallelogrammic linkage mechanism 10' includes a pair of front links 8' and a pair of rear links 9'. The upper ends of the respective links 8', 9' are pivotally connected to the side flanges 6a of the seat carrier 6 by means of upper pins 11', whereas bent intermediate portions of the respective links are pivotally connected to the side bars 25 of the tiltable member by means of lower pins 13'.

The front and rear links 8', 9' of each parallelogrammic linkage mechanism respectively have lower extensions 8a', 9a' which are formed with elongated guide slots 79 for slidably receiving pins 80. The pins 80 are fixed to a carriage 81 which consists of two bars associated with the respective parallelogrammic linkage mechanisms.

The carriage 81 rotatably supports a load applying roller 82 which comes into contact with the upper ends 16a' of the tilting control springs 16'. The carriage 81 also rotatably carries a pair of posture holding rollers 83 which come into rolling contact with the side bars 25 of the tiltable member 3, as best shown in FIG. 18.

When the weight of the sitter is applied to the seat S, the seat carrier 6 lowers against the biasing force of the weight responsive springs 7. As a result, the parallelogrammic linkage mechanisms 10' function to displace the carriage 81 rearwardly away from the lateral support shaft 4. At this time, the distance between the tiltable member 3 and the upper ends 16a' of the tilting control springs 16' is substantially kept constant, and the pins 80 are slidably movable within the respective guide slots 79. Thus, when the carriage 81 moves rearwardly, the load applying roller 82 rests only lightly on the upper ends 16a' of the tilting control springs 16' without pressing the spring upper ends, so that rearward displacement of the carriage 81 occurs very smoothly.

Figure 20:
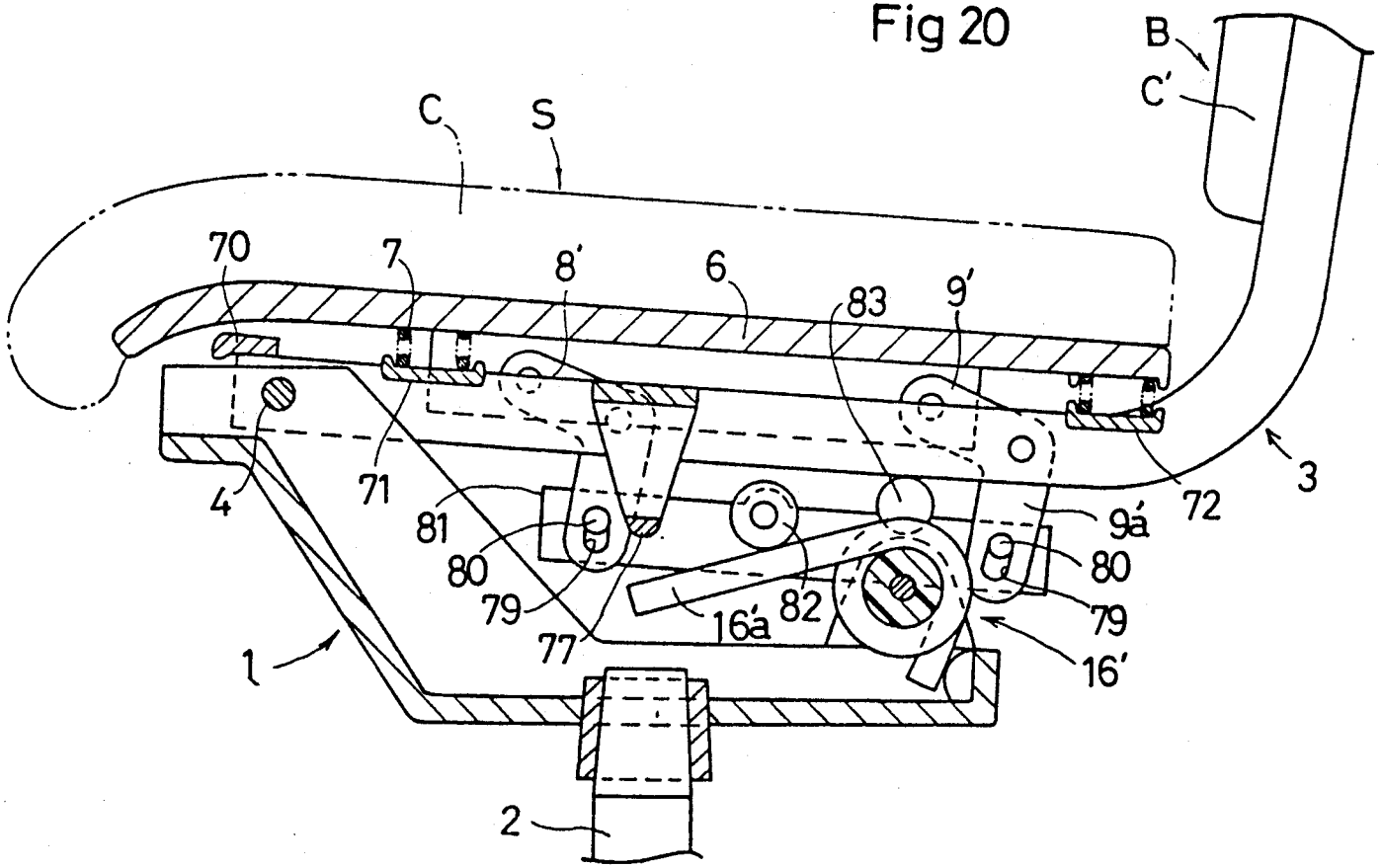
FIG. 20 is a sectional side view similar to FIG. 17 but showing the rocking chair when it is tilted.
Figure 21:
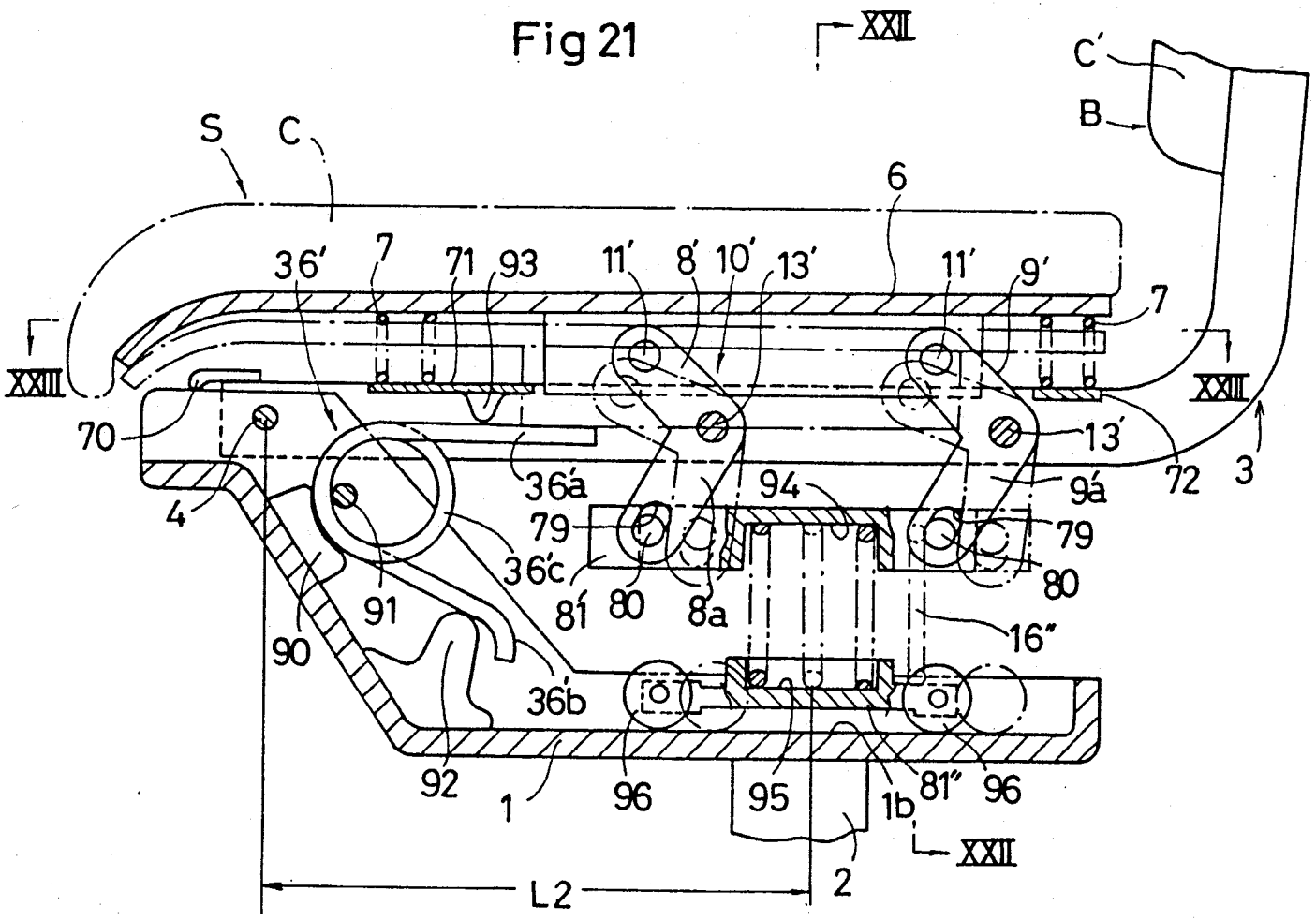
FIG. 21 is a sectional side view showing a rocking chair according to an eighth embodiment of the present invention.
Figure 22:
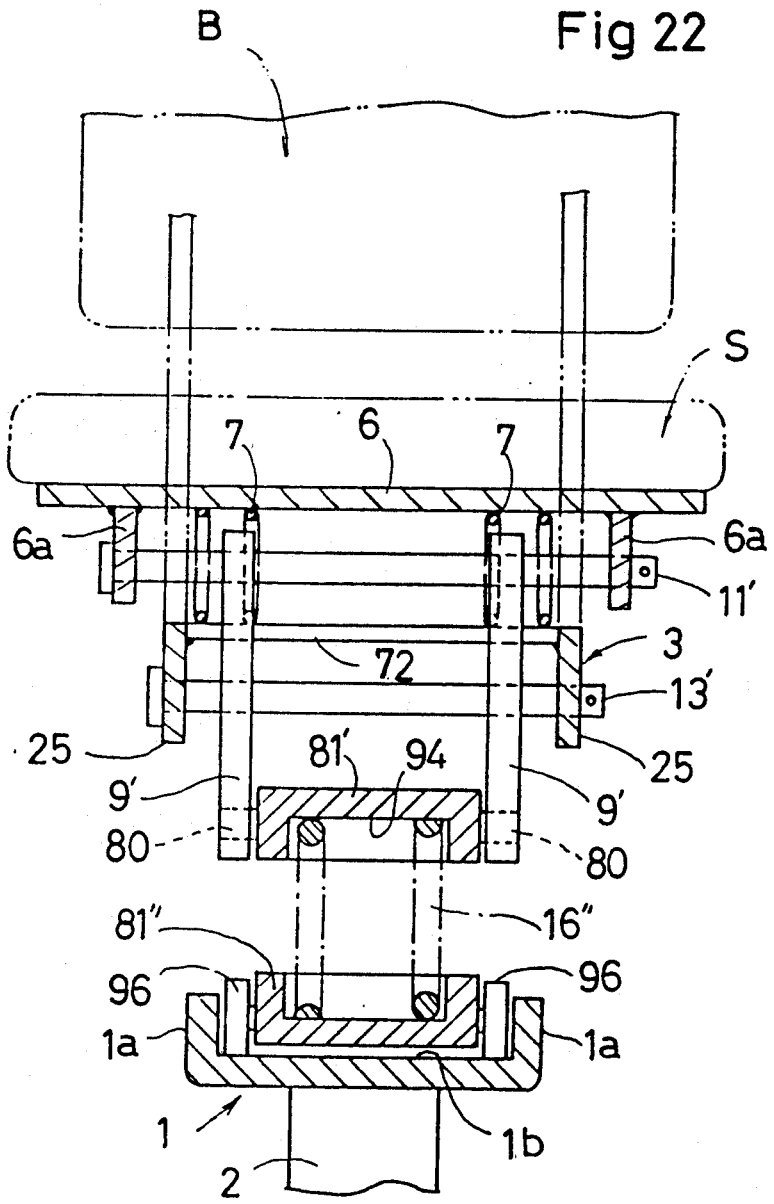
FIG. 22 is a sectional view taken on lines XXII—XXII in FIG. 21.
Figure 23:
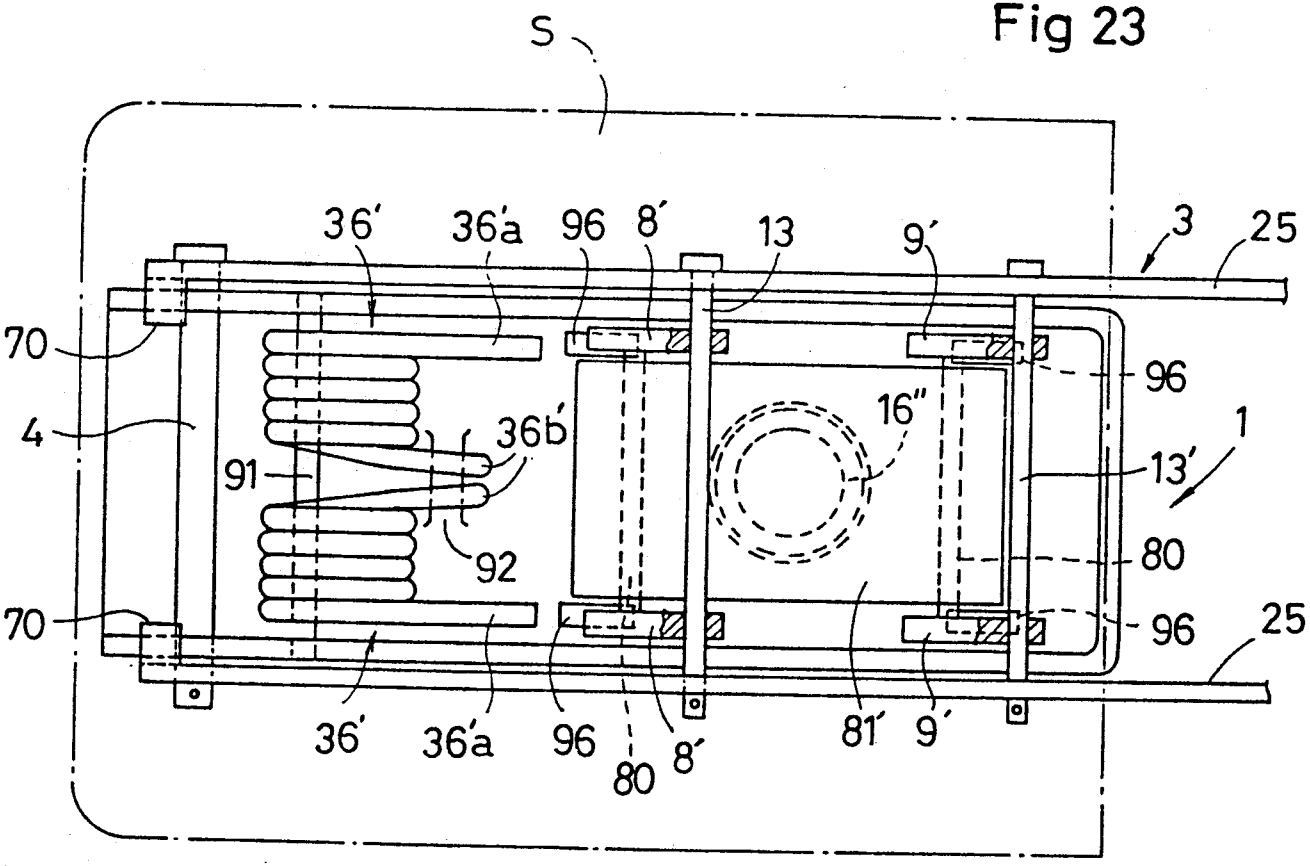
FIG. 23 is a sectional view taken on lines XXIII—XXIII in FIG. 21.
Figure 24:
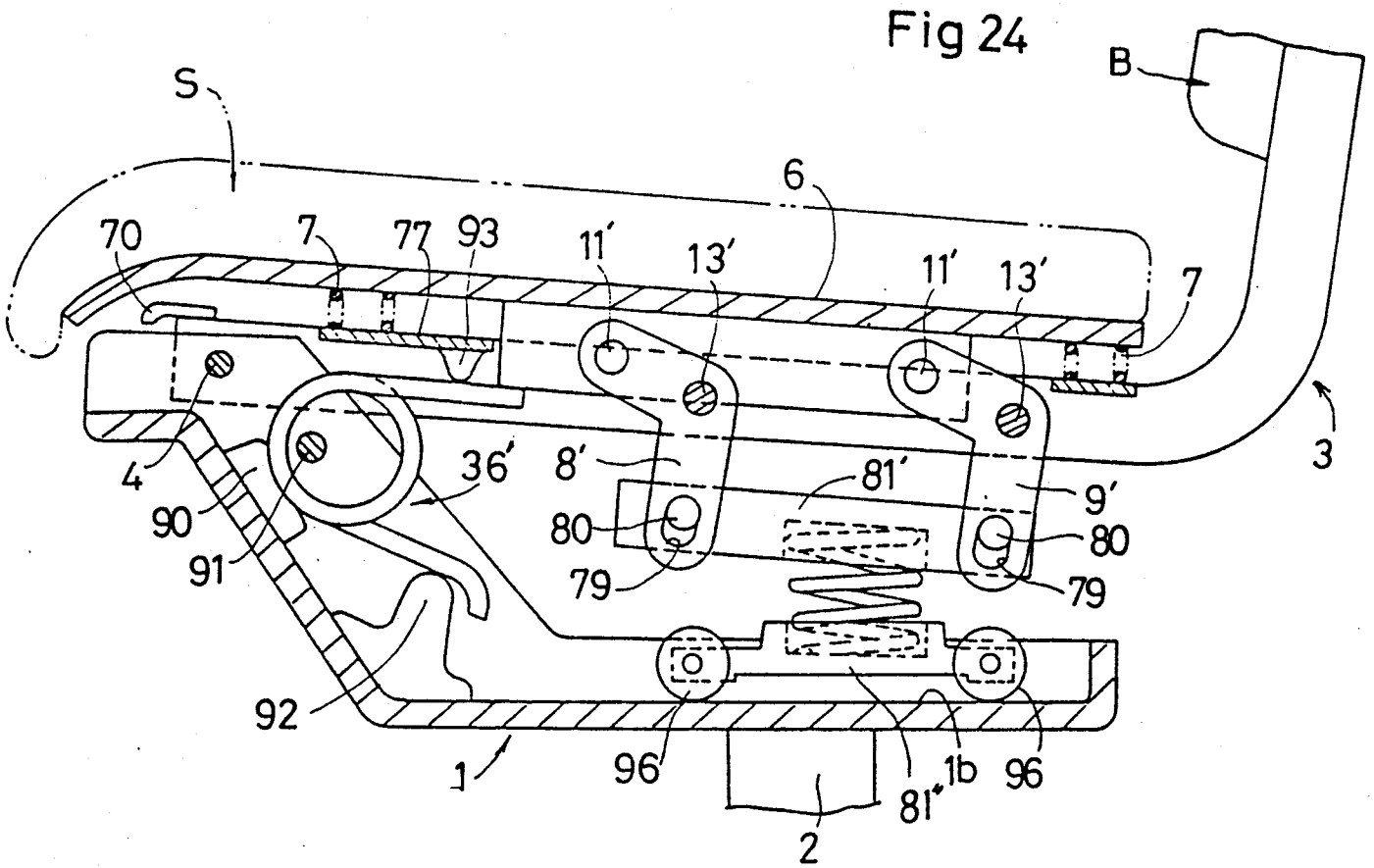
FIG. 24 is a sectional side view similar to FIG. 21 but showing the rocking chair when it is tilted.

Subsequently, when the sitter applies a leaning load onto the chair back B, the tiltable member 3 tilts downward by pivoting about the lateral support shaft 4. Because movement of the pins 80 is limited within the respective guide slots 79, the load applying roller 82 cannot escape beyond this limit. Thus, the load applying roller 82 must ultimately come into pressing contact with the upper ends 16a' of the tilting control springs 16', as shown in FIG. 20. As a result, the tiltable member 3 is supported against tilting by the tilting control springs 16'.

Obviously, the degree of rearward displacement of the load applying roller 82 (namely, the carriage 81) is roughly proportional to the sitter's weight. Thus, the reaction moment arm length L2 (see FIG. 17) for the tilting control springs 16' increases as the sitter's weight increases. As a result, the tilting control springs 16' provides a harder tilting support for a heavier sitter but a softer tilting support for a lighter sitter.

Further, according to the seventh embodiment, the distance L3 (effective spring arm length) from the load applying roller 82 to the coiled portion 16c' of each tilting control spring 16' decreases as the sitter's weight increases. Obviously, for a given vertical displacement of the load applying means, the spring coiled portion 16c' is torsioned to a greater degree as the effective spring arm length L3 increases. This function contributes greatly to improving the sensitivity of the tilting control spring 16' to variations of the sitter's weight. By contrast, any of the foregoing embodiment relies only on an increase of the reaction moment arm length L2.

The seventh embodiment illustrated in FIGS. 17 to 20 may be modified so that the load applying roller 82 is initially spaced slightly from the upper ends 16a' of the tilting control springs 16', but comes into pressing contact with the spring upper ends only when a leaning load is applied to the chair back B. In this way, the load applying roller 82 can displace even more smoothly for adjustment of the tilting control springs when the user simply sits on the seat S.

FIGS. 21 through 24 show an eighth embodiment of the present invention which differs from the seventh embodiment in the following respects.

The tiltable member 3 is held substantially horizontal by a pair of auxiliary torsional coil springs (kick springs) 36' when the weight of the sitter is applied to the seat S. Each auxiliary spring 36' has a coiled portion 36c' supported on the fixed frame 1 by means of an elastic bolster 90 (made of rubber for example) mounted on the fixed frame 1 and a lateral retention rod 91 extending within the coiled portion. The auxiliary spring 36' further has a rearwardly extending upper end 36a' and a downwardly rearwardly extending lower end 36b'.

The lower ends 36b' of the respective auxiliary springs 36' engage a pillow member 92 attached to the fixed frame 1. The front spring bearing cross bar 71 is provided, on its underside, with a projection 93 resting on the upper ends 36a' of the respective auxiliary springs 36'.

The seat carrier 6 is connected to the tiltable member 3 by means of a single parallelogrammic linkage mechanism 10' which works to rearwardly displace an upper carriage 81' when the sitter's weight is applied to the seat S. The arrangement itself of this linkage mechanism is roughly similar to each linkage mechanism of the foregoing embodiment.

The upper carriage 81 is formed, on its underside, with a bearing recess 94 for receiving the upper end of a tilting control compression coil spring 16''. The lower end of the tilting control spring 16'' is received in another bearing recess 95 of a lower carriage 81'' which is provided with wheel rollers 96 to run on a flat bottom surface 1*b* of the fixed frame 1.

According to the eighth embodiment described above, the tilting control compression spring 16'' as a whole is displaced rearwardly together with the upper and lower carriages 81', 81'', thereby increasing the reaction moment arm length L2 substantially in proportional relation to the sitter's weight. Thus, the tilting control spring 16'' is automatically adjusted to suit the sitter's weight.

The present invention being thus described, it is obvious that the same may be varied in many other ways. For instance, the spring acting point of the tilting control spring or springs relative to the tiltable member may be displaced rearwardly by a electrical or electronic device which receives a control signal corresponding to the weight of the sitter. Further, the spring acting point of the tilting control spring or springs may be displaced by a hydraulic device which is hydraulically actuated by downward displacement of the seat. Such variations are not to be regarded as a departure from the spirit and scope of the invention, and all such modifications as would be obvious to those skilled in the art are intended to be included within the scope of the following claims.

We claim:

1. A tilting control assembly for a chair, said chair comprising support means; a tiltable member pivotally connected to said support means by lateral shaft means, said tiltable member being downwardly tiltable by pivoting about said lateral support shaft means; and a seat carrier arranged above said support means to move downwardly toward said support means against weight responsive spring means under the weight of a sitter, said weight responsive spring means being arranged under said seat carrier; said tilting control assembly comprising:

tilting control spring means arranged between said support means and said tiltable member to provide a support position for elastically supporting said tiltable member against tilting thereof relative to said support means; and displacing means responsive to said weight for automatically displacing said support position relative to said tiltable member in a manner such that said support position becomes farther from said support shaft means as said weight increases.

2. The tilting control assembly according to claim 1, wherein said tilting control spring means comprises at least one torsional coil spring having a pair of extended ends, one end of said torsional coil spring being pivotally supported by said support means, the other end of said torsional coil spring bearing against said tiltable member, said displacing means serving to displace said other end of said torsional coil spring rearwardly farther from said support shaft means as said weight increases.

3. The tilting control assembly according to claim 1, wherein said tilting control spring means comprises at least one torsional coil spring having a pair of extended ends, one end of said torsional coil spring being fixedly caught by said support means, the other end of said torsional coil spring extending toward said support shaft means, said tiltable member being supported by said other end of said torsional coil spring via movable load applying means which is arranged between said tiltable member and said other end of said torsional coil spring, said displacing means serving to displace said movable load applying means rearwardly farther from said support shaft means as said weight increases.

4. The tilting control assembly according to claim 1, wherein said tilting control spring means comprises at least one compression spring which is received by a carriage movable on said support means, said displacing means serving to displace said carriage together with the entirety of said compression spring farther from said support shaft means as said weight increases.

5. The tilting control assembly according to claim 1, wherein said weight responsive spring means comprises at least one compression spring arranged between said tiltable member and said seat carrier.

6. The tilting control assembly according to claim 1, wherein said weight responsive spring means comprises at least one leaf spring having one end fixed to said support means, the other end of said leaf spring supporting said seat carrier.

7. The tilting control assembly according to claim 1, wherein said seat carrier is arranged above said tiltable member, said seat carrier approaching said tiltable member when moving downward, said displacing means functioning to convert approaching movement of said seat carrier relative to said tiltable member into displacement of said support position away from said support shaft means.

8. The tilting control assembly according to claim 7, wherein said seat carrier also supports a chair back behind a chair seat and is tiltable with said tiltable member.

9. The tilting control assembly according to claim 7, wherein said tiltable member supports a chair back behind a chair seat.

* * * * *